United States Patent [19]

McAlister, deceased

[11] 4,032,877

[45] June 28, 1977

[54] PROTECTOR FOR ELECTRIC CIRCUITS

[75] Inventor: Craig L. McAlister, deceased, late of Florissant, Mo., by George Ruxton McAlister, executor

[73] Assignee: McGraw-Edison Company, Elgin, Ill.

[22] Filed: May 3, 1976

[21] Appl. No.: 682,649

[52] U.S. Cl. ..... 337/148; 337/164; 337/219; 337/404; 337/409

[51] Int. Cl.[2] ..... H01H 71/20; H01H 37/76

[58] Field of Search ..... 337/148, 164, 165, 182, 337/219, 244, 267, 292, 314, 404, 409, 413, 414, 315

[56] References Cited

UNITED STATES PATENTS

| | | | |
|---|---|---|---|
| 2,805,304 | 9/1957 | Smith | 337/404 |
| 2,913,555 | 11/1959 | McAlister | 337/164 |
| 3,183,327 | 5/1965 | Kozacka | 337/219 |
| 3,301,981 | 1/1967 | Urani | 337/404 |

*Primary Examiner*—Robert J. Hickey
*Attorney, Agent, or Firm*—Rogers, Eilers & Howell

[57] ABSTRACT

A heat-sensitive protector, that is connectable into an electric circuit, has an elongated, effectively non-fusing element which performs the function of a connector as long as that protector is intact, and thereafter moves fron a retracted position to an extended position to perform the function of an indicator when that protector responds to heat to open that circuit. That element spans the full distance between the terminals of that heat-sensitive protector.

13 Claims, 5 Drawing Figures

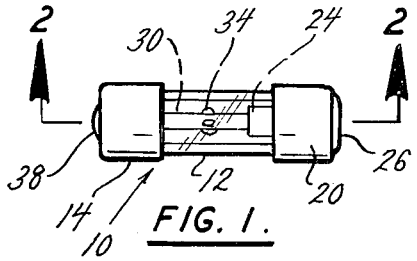
FIG. 1.
FIG. 2.
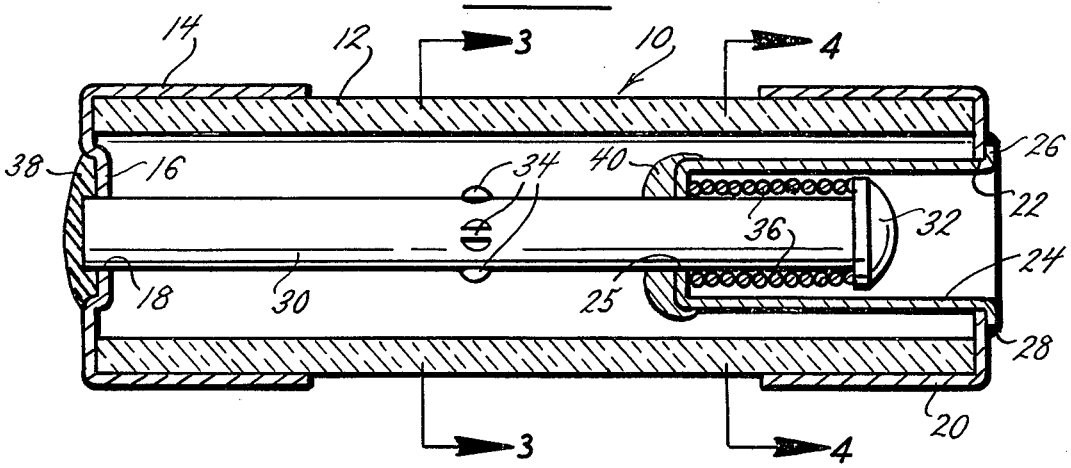
FIG. 3.
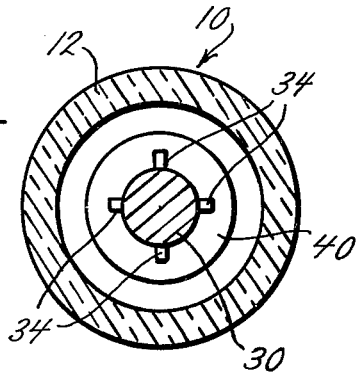
FIG. 4.
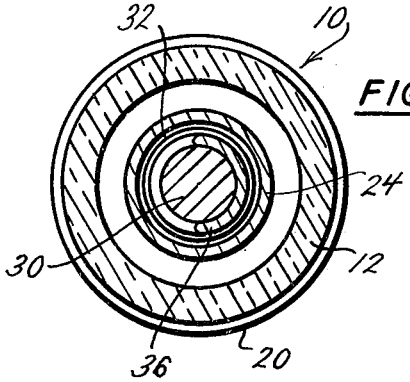
FIG. 5.
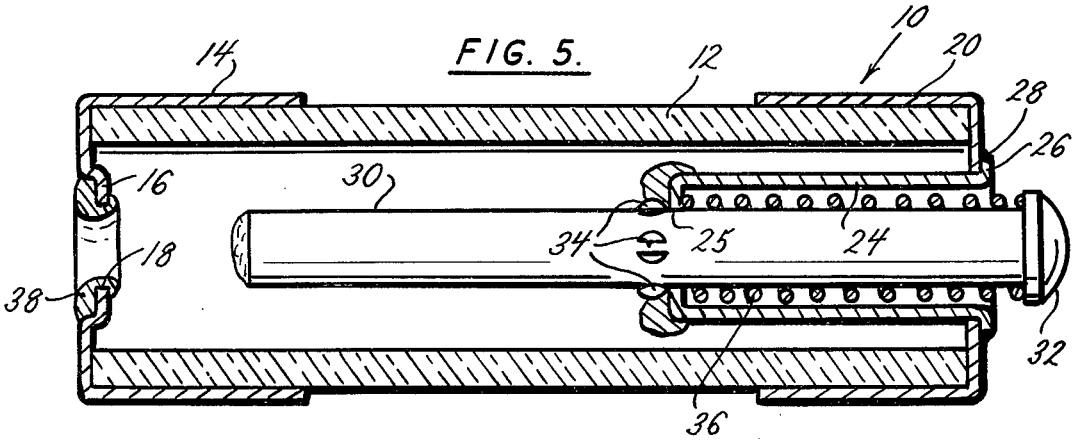

PROTECTOR FOR ELECTRIC CIRCUITS

BACKGROUND OF THE INVENTION

Devices of the kind shown in U.S. Pat. Nos. 2,790,049, 2,805,304, 2,913,555 and 3,301,981 are intended to be incorporated into electric circuits; and they are intended to open those electric circuits whenever the temperatures adjacent those devices exceed predetermined values.

SUMMARY OF THE INVENTION

The present invention provides a device which is connectable into an electric circuit, and which can respond to increases in the temperature thereof to open that electric circuit. That device has an elongated, effectively, non-fusing element which extends between and is mechanically secured and electrically bonded to the terminals of that device, as long as the temperature of that device does not exceed a predetermined value. That elongated element will, whenever the temperature of that device exceeds that predetermined value, bodily move to open that electric circuit and also to move a portion thereof from a normally-retracted position to an extended position to act as an indicator. It is, therefore, an object of the present invention to provide a device that has an elongated, effectively non-fusing element which normally extends between and is mechanically secured and electrically bonded to the terminals of that device but which will, whenever the temperature of that device exceeds that predetermined value, bodily move to open the circuit and also to move a portion thereof from a normally-retracted position to an extended position to act as an indicator.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING:

In the drawing, FIG. 1 is a front elevational view of one preferred embodiment of protector for electric circuits which is made in accordance with the principles and teachings of the present invention, FIG. 2 is a sectional view, on a much larger scale, through the protector for electric circuits that is shown in FIG. 1, and it is taken along the plane indicated by the line 2—2 in FIG. 1, FIG. 3 is a sectional view, on the scale of FIG. 2, through the protector for electric circuits of FIG. 1, and it is taken along the plane indicated by the line 3—3 in FIG. 2, FIG. 4 is another sectional view, on the scale of FIG. 2, through the protector for electric circuits of FIG. 1, and it is taken along the plane indicated by the line 4—4 in FIG. 2, and FIG. 5 is a sectional view which is similar to FIG. 2 but which shows the protector for electric circuit after it has opened the circuit.

DETAILED DESCRIPTION OF THE PREFERRED EMBODIMENT

In the drawing, the numeral 10 generally denotes a protector for electric circuits which can be mounted in fuse clips or the like to incorporate it into an electric circuit. That protector for electric circuits has a tubular casing 12 which is shown as being made of glass; but that casing could be made of fiber, steatite or other suitable insulating material.

The numeral 14 generally denotes a ferrule-type metal terminal which has a shallow circular recess 16 in the end wall thereof, and which has an opening 18 in the center of that recess. The cylindrical portion of the terminal 14 is dimensioned to telescope over the left-hand end of the casing 12, as shown by FIGS. 2 and 5. The numeral 20 generally denotes a ferrule-type metal terminal which has an opening 22 therein, which has an eyelet 24 mounted within said opening, and which has high temperature solder 28 fixedly securing the annular flange 26 of that eyelet to those portions of the end wall of that terminal which define the opening 22. As a result, the eyelet 24 is, effectively, an integral part of the terminal 20. That eyelet has an opening 25 in the inner end thereof.

The numeral 30 generally denotes a stiff, elongated, homogeneous current-conducting member which has the left-hand end thereof dimensioned to extend into the opening 18 in the center of the recess 16 of terminal 14, and which has the right-hand portion thereof dimensioned to be disposed within the opening 25 in the eyelet 24 of terminal 20. The numeral 32 denotes an enlarged head for the elongated current-conducting member 30, and that head normally is retracted into position within the eyelet 24 of terminal 20, as shown particularly by FIG. 2. Protuberances 34 are formed on the shank of the current-conducting member 30 to limit the extent to which that current-conducting member can shift to the right relative to the eyelet 24 of terminal 20. Those protuberances are formed on the shank of that current-conducting member after that shank has been passed through a helical compression spring 36 and has then been passed through the opening 25 in the eyelet 24 of terminal 20. Those protuberances can easily be made by a staking process.

The numeral 38 denotes a mass of heat-softenable alloy which is disposed within the recess 16 of the terminal 14 and which mechanically secures and electrically bonds the left-hand end of the shank of the current-conducting member 30 to that terminal. The numeral 40 denotes a mass of heat-softenable material which mechanically secures and electrically bonds the shank of that current-conducting member to the eyelet 24 of terminal 20.

The normal positions of the components of the protector for electric curcuits are shown in FIGS. 1 and 2. As long as those components remain in those positions, current can flow from terminal 14 directly and indirectly through the mass of heat-softenable alloy 38 into the current-conducting member 30, through that member, directly or indirectly via the mass of heat-softenable alloy 40 into the eyelet 24 of terminal 20, and then directly or indirectly via the high temperature solder 28 to the end wall of that terminal.

If the temperature of the protector for electric circuit 10 were to rise above the relatively-low softening temperature of the masses 38 and 40 of heat-softenable alloy, the helical compression spring would move the current-conducting member 30 from the position of FIG. 2 to the position of FIG. 5. Further movement of that current-conducting member to the right would be prevented by the engagement of the protuberances 34 with the left-hand end of eyelet 24 of terminal 20. In moving from the position of FIG. 2 to the position of FIG. 5, the current-conducting member 30 would move the left-hand end thereof away from the terminal 14 to open the circuit, and would move the head 32 thereof to indicating position. would move the left-hand end thereof away from the terminal 14 to open the circuit, and would move the head 32 thereof to indicating position.

Subsequently, when the masses 38 and 40 of heat-softenable material cooled, the latter mass of heat-softenable material would harden and would fixedly secure the current-conducting member 30 in position relative to the eyelet of terminal 20. As a result, the head 32 of that current-conducting member would thereafter be fixedly held in extended position, and wou'd thereby positively and continuously indicate that the protector for electric circuits had opened the circuit.

It will be noted that the current-conducting member 30 is able to perform the dual functions of directly engaging and interconnecting the terminals 14 and 20 and of subsequently acting as an indicator. Specifically, in the position indicated by FIGS. 1 and 2, the current-conducting member 30 performs the function of directly engaging and interconnecting the terminals 14 and 20. In the position shown by FIG. 5, the current-conducting member performs the function of indicating that the protector for electric circuits has opened the circuit. Because the current-conducting member 30 is homogeneous, and because it directly engages and interconnects the terminals 14 and 20, the protector for electric circuits is free of electrical interfaces in the current-conducting element thereof.

The current-conducting member 30 is not intended to fuse during the normal or circuit-opening operation of the protector for electric circuits. Instead, that current-conducting member remains effectively un-fused during the normal or circuit-opening operation of that protector for electric circuits; and it opens the circuit by bodily moving away from the terminal 14. Prior to the time the masses 38 and 40 of heat softenable material soften, the mass 40 of heat softenable material will relieve the major portion of the length of the current-conducting member 30 of stresses induced by the helical compression spring 36.

Whereas the drawing and accompanying description have shown and described a preferred embodiment of the present invention it should be apparent to those skilled in the art that various changes may be made in the form of the invention without affecting the scope thereof.

What I claim is:

1. A circuit-controlling device which can be incorporated into an electric circuit to open said electric circuit whenever the temperature of said circuit-controlling device reaches a predetermined value and which comprises a housing, a first terminal adjacent one end of said housing, a second terminal adjacent the other end of said housing, and elongated recess in said first terminal, said first terminal having an opening in the inner end of said recess, said second terminal having an opening therein, an elongated current-conducting member which is disposed within said housing and which remains un-fused throughout the operation of said circuit-controlling device and throughout the opening of said electric circuit whenever the temperature of said circuit-controlling device reaches said predetermined value, said elongated current-conducting member having a portion thereof normally lodged within said opening at said inner end of said recess in said first terminal, said elongated current-conducting member having another portion thereof extending from said opening at said inner end of said recess in said first terminal to said opening in said second terminal and having one end of said other portion lodged within said opening in said second terminal, said elongated current-conducting member having a further portion thereof extending from said opening at said inner end of said recess in said first terminal into said recess in said first terminal, a spring which biases all portions of said elongated current-conducting member for movement relative to said housing and thereby biases said end of said other portion of said elongated current-conducting member for movement away from said opening in said second terminal to open said electric circuit and also biases said further portion of said elongated current-conducting member for movement outwardly of said recess in said first terminal and hence for movement from a normally-retracted position toward an extended position, a mass of heat softenable material which normally provides a mechanical connection, and normally helps provide an electrical bond, between said other portion of said elongated current-conducting member and said second terminal, and a second mass of heat softenable material which normally provides a mechanical connection, and normally helps provide an electrical bond, between the first said portion of said elongated current-conducting member and said first terminal, said masses of heat softenable material and said elongated current-conducting member holding said electric circuit closed as long as the temperature of said circuit-controlling device does not exceed said predetermined value, both of said masses of heat softenable material responding to a temperature above said predetermined value to soften and thereby permit said spring to move all portions of said elongated current-conducting member axially relative to said housing and thereby move said other portion of said elongated current-conductint member away from said second terminal to open said electric circuit and also to move said further portion of said elongated current-conducting member to said extended position.

2. A circuit-controlling device as claimed in claim 1 wherein said elongated current-conducting member is stiff and does not bend during the operation of said circuit-controlling device or during the opening of said electric circuit whenever the temperature of said circuit-controlling device reaches said predetermined value.

3. A circuit-controlling device as claimed in claim 1 wherein said elongated current-conducting member is shorter than said housing, whereby the outer end of said further portion of said elongated current-conducting member is spaced inwardly of the outer end of said first terminal when said one end of said other portion of said elongated current-conducting member is lodged within said opening in said second terminal.

4. A circuit-controlling device as claimed in claim 1 wherein said elongated current-conducting member normally performs the function of a current-conducting member, and wherein said elongated current-conducting member performs the function of an indicator whenever said circuit-controlling device has opened said electric circuit, whereby said elongated current-conducting member performs a dual function during the operation of said circuit-controlling device.

5. A circuit-controlling device as claimed in claim 1 wherein said elongated current-conducting member has a surface thereon which can coact with a surface on said recess in said first terminal to prevent unlimited movement of said elongated current-conducting member outwardly from said recess in said first terminal.

6. A circuit-controlling device as claimed in claim 1 wherein said elongated current-conducting member is a one piece homogeneous member which spans the full distance between said opening at said inner end of said recess in said first terminal and said opening in said second terminal.

7. A circuit-controlling device which can be incorporated into an electric circuit to open said electric circuit whenever the temperature of said circuit-controlling device reaches a predetermined value and which commprises a housing, a first terminal adjacent one end of said housing, a second terminal adjacent the other end of said housing, an opening in said first terminal, said second terminal having an opening therein, an elongated current-conducting member which is disposed within said housing and which remains un-fused throughout the operation of said circuit-controlling device and throughout the opening of said electric circuit whenever the temperature of said circuit-controlling device reaches said predetermined value, said elongated current-conducting member having a portion thereof normally lodged within said opening in said first terminal, said elongated current-conducting member having another portion thereof extending from said opening in said first terminal to said opening in said second terminal and having one end of said other portion lodged within said opening in said second terminal, a spring which biases all portions of said elongated current-conducting member for movement relative to said housing and thereby biases said end of said other portion of said elongated current-conducting member for movement away from said opening in said second terminal to open said electric circuit and also biases said elongated current-conducting member from a normally-retracted position toward an extended position, a mass of heat softenable material which normally provides a mechanical connection, and normally helps provide an electrical bond, between said other portion of said elongated current-conducting member and said second terminal, and a second mass of heat softenable material which normally provides a mechanical connection, and normally helps provide an electrical bond, between the first said portion of said elongated current-conducting member and said first terminal, said masses of heat softenable material and said elongated current-conducting member holding said electric circuit closed as long as the temperature of said circuit-controlling device does not exceed and predetermined value, both of said masses of heat softenable material responding to a temperature above said predetermined value to soften and thereby permit said spring to move all portions of said elongated current-conducting member axially relative to said housing and thereby move said other portion of said elongated current-conducting member away from said second terminal to open said electric circuit and also to move said elongated current-conducting member to said extended position.

8. A circuit-controlling device which can be incorporated into an electric circuit to open said electric circuit whenever the temperature of said circuit-controlling device reaches a predetermined value and which comprises a housing, a first terminal adjacent one end of said housing, a second terminal adjacent the other end of said housing, an opening in said first terminal, an elongated current-conducting member which is disposed within said housing and which remains unfused throughout the operation of said circuit-controlling device and throughout the opening of said electric circuit whenever the temperature of said circuit-controlling device reaches said predetermined value, said elongated current-conducting member having a portion thereof normally lodged within said opening in said first terminal, said elongated current-conducting member having another portion thereof extending from said opening in said first terminal to said second terminal, a spring which biases all portions of said elongated current-conducting member for movement relative to said housing and thereby biases said other portion of said elongated current-conducting member for movement away from sid second terminal to open said electric circuit and also biases said elongated current-conducting member from a normally-retracted position toward an extended position, a mass of heat softenable material which normally provides a mechanical connection, and normally helps provide an electrical bond, between said other portion of said elongated current-conducting member and said second terminal, and a second mass of heat softenable material which normally provides a mechanical connection, and normally helps provide an electrical bond, between the first said portion of said elongated current-conducting member and said first terminal, said masses of heat softenable material and said elongated current-conducting member holding said electric circuit closed as long as the temperature of said circuit-controlling device does not exceed said predetermined value, both of said masses of heat softenable material responding to a termperature above said predetermined value to soften and thereby permit said spring to move all portions of said elongated current-conducting member axially relative to said housing and thereby move said other portion of said elongated current-conducting member away from said second terminal to open said electric circuit and also to move said elongated current-conducting member to said extended position.

9. A circuit-controlling device as claimed in claim 8 wherein said elongated current-conducting member is stiff and does not bend during the operation of said circuit-controlling device or during the opening of said electric circuit whenever the temperature of said circuit-controlling device reaches said predetermined value.

10. A circuit-controlling device as claimed in claim 8 wherein said elongated current-conducting member normally performs the function of a current-conducting member, and wherein said elongated current-conducting member performs the function of an indicator whenever said circuit-controlling device has opened said electric circuit, whereby said elongated current-conducting member performs a dual function during the operation of said circuit-controlling device.

11. A circuit-controlling device as claimed in claim 8 wherein said elongated current-conducting member has a surface thereon which can coact with a surface on said first terminal to prevent unlimited movement of said elongated current-conducting member outwardly from said first terminal.

12. A circuit-controlling device as claimed in claim 8 wherein said opening in said first terminal is in the inner end of an elongated recess in said first terminal, wherein said elongated current-conducting member has an enlarged head that normally is disposed within said elongated recess in said first terminal, and wherein said enlarged head is located outwardly of said elongated recess in said first terminal whenever said elongated current-conducting member is in said extended position.

13. A circuit-controlling device which can be incorporated into an electric circuit to open said electric circuit whenever the temperature of said circuit-controlling device reaches a predetermined value and which comprises a housing, a first terminal adjacent one end of said housing, a second terminal adjacent the other end of said housing, an opening in said first terminal, an elongated current-conducting member which is disposed within said housing and which remains unfused throughout the operation of said circuit-controlling device and throughout the opening of said electric circuit whenever the temperature of said circuit-controlling device reaches said predetermined value, said elongated current-conducting member having a portion thereof normally lodged within said opening in said first terminal, said elongated current-conducting member being a unitary homogeneous piece of metal which spans the distance between said second terminal and said opening in said first terminal, a spring which biases said elongated current-conducting member for movement relative to said housing and thereby biases said elongated current-conducting member for circuit-opening movement away from said second terminal and thereby also biases said elongated current-conducting member from a normally-retracted position toward an extended position, a mass of heat softenable material which normally provides a mechanical connection, and normally helps provide an electrical bond, between said elongated current-conducting member and said second terminal, and a second mass of heat softenable material which normally provides a mechanical connection, and normally helps provide an electrical bond between said elongated current-conducting member and said first terminal, said masses of heat softenable material and said elongated current-conducting member holding said electric circuit closed as long as the temperature of said circuit-controlling device does not exceed said predetermined value, both of said masses of heat softenable material responding to a temperature above said predetermined value to soften and thereby permit said spring to move said elongated current-conducting member axially relative to said housing and thereby move said elongated current-conducting member away from said second terminal to open said electric circuit and also to move said elongated current-conducting member to said extended position, one of said masses of heat softenable material relieving the major portion of the length of said elongated current-conducting member of stresses applied by said spring.

* * * * *

UNITED STATES PATENT AND TRADEMARK OFFICE

CERTIFICATE OF CORRECTION

PATENT NO. : 4,032,877
DATED : June 28, 1977
INVENTOR(S) : Craig L. McAlister

It is certified that error appears in the above-identified patent and that said Letters Patent are hereby corrected as shown below:

Column 5, line 59, cancel "and" and substitute -said-

Column 6, line 23, cancel "sid" and substitute -said-

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*